US011769404B2

(12) United States Patent
Ramirez

(10) Patent No.: US 11,769,404 B2
(45) Date of Patent: Sep. 26, 2023

(54) METHOD AND APPARATUS FOR ACTUATING A PUSH-TO-WALK BUTTON

(71) Applicant: Juan Carlos Ramirez, Costa Mesa, CA (US)

(72) Inventor: Juan Carlos Ramirez, Costa Mesa, CA (US)

( * ) Notice: Subject to any disclaimer, the term of this patent is extended or adjusted under 35 U.S.C. 154(b) by 0 days.

(21) Appl. No.: 17/476,416

(22) Filed: Sep. 15, 2021

(65) Prior Publication Data

US 2022/0180742 A1 Jun. 9, 2022

Related U.S. Application Data

(60) Provisional application No. 63/078,849, filed on Sep. 15, 2020.

(51) Int. Cl.

| | |
|---|---|
| ***G08G 1/005*** | (2006.01) |
| ***G08G 1/07*** | (2006.01) |
| ***G08G 1/096*** | (2006.01) |

(52) U.S. Cl.
CPC ..... *G08G 1/07* (2013.01); *G08G 1/005* (2013.01); *G08G 1/096* (2013.01)

(58) Field of Classification Search
None
See application file for complete search history.

(56) References Cited

U.S. PATENT DOCUMENTS

2005/0255273 A1* 11/2005 Gorman ..... E01F 9/512 428/354
2011/0140923 A1* 6/2011 Keller ..... G09F 27/00 340/944

* cited by examiner

*Primary Examiner* — John F Mortell
(74) *Attorney, Agent, or Firm* — Puritan Law; Jack Jmaev

(57) ABSTRACT

A method and apparatus for actuating a push-to-walk button wherein a force is received upon a pedal. The force is applied to an electrical switch. In turn, the electrical switch engages a push-to-walk circuit input signal.

7 Claims, 6 Drawing Sheets

METHOD AND APPARATUS FOR ACTUATING A PUSH-TO-WALK BUTTON

The present application claims priority to U.S. Provisional Application Ser. No. 63/078,849, entitled "METHOD AND APPARATUS FOR ACTUATING A PUSH-TO-WALK BUTTON" by Ramirez, which was filed on Sep. 15, 2021 the text and drawings of which are incorporated by reference into this application in their entirety.

BACKGROUND

In the past few months, the entire world including the United States has found itself in an epoch battle against an invisible enemy—the coronavirus (a.k.a. "COVID-19"). In an effort to quell the spread of COVID-19, governments around the world have ordered citizens to stay in their homes. This is also true in the United States, where several states have issued "shelter-in-place" orders. The Federal Government in the United States has also advised the population to "avoid social gatherings in groups of more than 10 people", see "The President's Coronavirus Guidelines for America" published on or about Mar. 16, 2020. These guidelines further discourage discretionary travel, shopping trips, and social visits.

The President's guidelines have now been interpreted to require many small businesses in many various industries to effectively shut down during the course of what is now an ongoing COVID-19 pandemic. It is not unfair to say that America, as well as the rest of the world, is closed for business. This is reflected in massive losses in equity markets around the globe. In response to our country's collapsing financial situation, the Federal Government is attempting to infuse capital into the economy. The Federal Reserve has also slashed interest rates. The Federal Government has crafted massive financial recovery legislation, which will infuse trillions of dollars into the American economy. Despite all of these economic stimulus measures, every business in the United States needs to forge their own recovery plan. Government support, although a factor in recovery, is not likely to be effective unless every business develops a recovery plan specific to their own unique circumstances.

As the global population begins working again, people will again take to the streets and flood back into their offices. Common activities of the past will require new protocols to reduce the spread of the current, or any other infectious disease. There are many apparatus in our urban landscape which require human interaction by way of a pushbutton. For example, automatic teller machines require physical touching in order to enter a transaction request. Many of the apparatus we interact with will require update so that they may be operated in a "contactless" manner.

Even before the pandemic befell our world, many modern devices were already embracing a touchless operational paradigm. For example, many gasoline dispensers have been retrofitted so as to interact with a cellular telephone for payment processing. But, there are many apparatus that are simply difficult to retrofit to support contactless operation.

In the vast majority of our cities and urban clusters, signal lights used to govern the flow of automotive traffic also provide mechanisms for the safe passage of pedestrians across an intersection. We've all come to know that a button must be pushed to indicate a pedestrian is present and the desires to cross the street. As more and more people return to normal, or a quasi-normal existence, there will be reluctance to make contact with a "push-to-walk" button because of the numerous people that previously made contact with the same button. Accordingly, even a push-to-walk button will need to be retrofitted in order to help reduce the spread of coronavirus, or other infectious disease.

Many people will continue working from home. This allows for more leisure time, and more walks around the neighborhood. Also, as carbon emission reduction efforts increase we will see more people take to electric bikes and scooters and they will also need to use a push-to-walk button. No one should contract a pathogen when they cross a street.

BRIEF DESCRIPTION OF THE DRAWINGS

Several alternative embodiments will hereinafter be described in conjunction with the appended drawings and figures, wherein like numerals denote like elements, and in which.

DETAILED DESCRIPTION

In the interest of clarity, several example alternative methods are described in plain language. Such plain language descriptions of the various steps included in a particular method allow for easier comprehension and a more fluid description of a claimed method and its application. Accordingly, specific method steps are identified by the term "step" followed by a numeric reference to a flow diagram presented in the figures, e.g. (step 5). All such method "steps" are intended to be included in an open-ended enumeration of steps included in a particular claimed method. For example, the phrase "according to this example method, the item is processed using A" is to be given the meaning of "the present method includes step A, which is used to process the item". All variations of such natural language descriptions of method steps are to be afforded this same open-ended enumeration of a step included in a particular claimed method.

Unless specifically taught to the contrary, method steps are interchangeable and specific sequences may be varied according to various alternatives contemplated. Accordingly, the claims are to be construed within such structure. Further, unless specifically taught to the contrary, method steps that include the phrase " . . . comprises at least one or more of A, B, and/or C . . . " means that the method step is to include every combination and permutation of the enumerated elements such as "only A", "only B", "only C", "A and B, but not C", "B and C, but not A", "A and C, but not B", and "A and B and C". This same claim structure is also intended to be open-ended and any such combination of the enumerated elements together with a non-enumerated element, e.g. "A and D, but not B and not C", is to fall within the scope of the claim. Given the open-ended intent of this claim language, the addition of a second element, including an additional of an enumerated element such as "2 of A", is to be included in the scope of such claim. This same intended claim structure is also applicable to apparatus and system claims.

In many cases, description of various alternative example methods is augmented with illustrative use cases. Description of how a method is applied in a particular illustrative use case is intended to clarify how a particular method relates to physical implementations thereof. Such illustrative use cases are not intended to limit the scope of the claims appended hereto.

Figure 1:
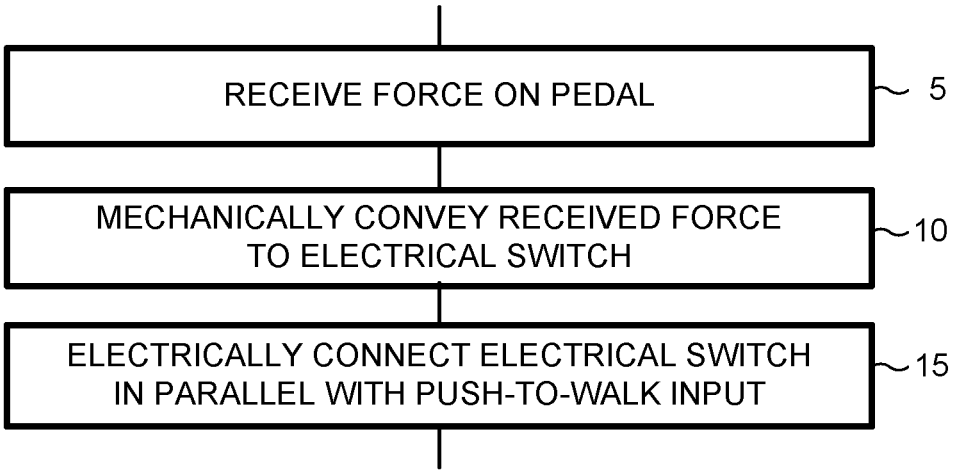
FIG. 1 is a flow diagram that depicts one example method for actuating a push-to-walk button.

FIG. 1 is a flow diagram that depicts one example method for actuating a push-to-walk button. According to this illustrative method, a push to walk button is actuated by receiving a force on the pedal (step 5), mechanically conveying the received force to an electrical switch (step 10), and electrically connecting the electrical switch to a push to walk button input (step 15). Each of the foregoing enumerated steps are included in this example method.

Figure 2:
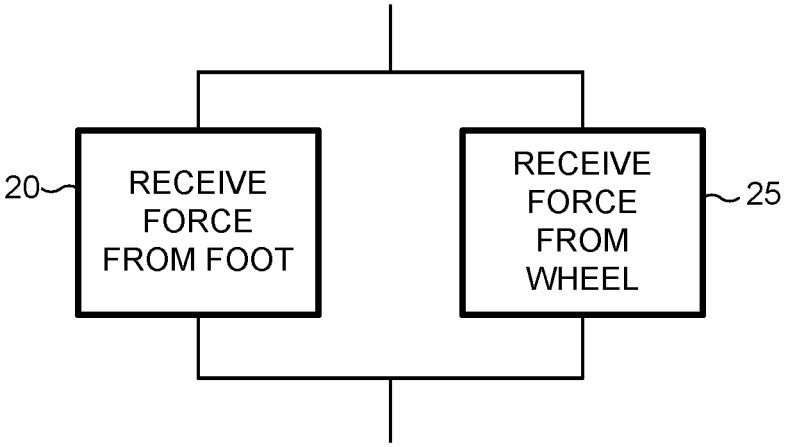
FIG. 2 is a flow diagram that depicts two alternative example methods for receiving a force upon the pedal.

FIG. 2 is a flow diagram that depicts two alternative example methods for receiving a force upon the pedal. According to one alternative example method, a force is received from a foot (step 20). This alternative example method is useful in those instances where a user presses the pedal with, for example, the toe of their foot. According to yet another alternative example method, a force is received from a wheel (step 25). According to one illustrative use case, a wheel of a wheelchair is used to apply a force to the pedal. Notwithstanding the foregoing alternative example use cases, the scope of the claims appended hereto are not intended to be limited by these illustrative descriptions.

Figure 3:
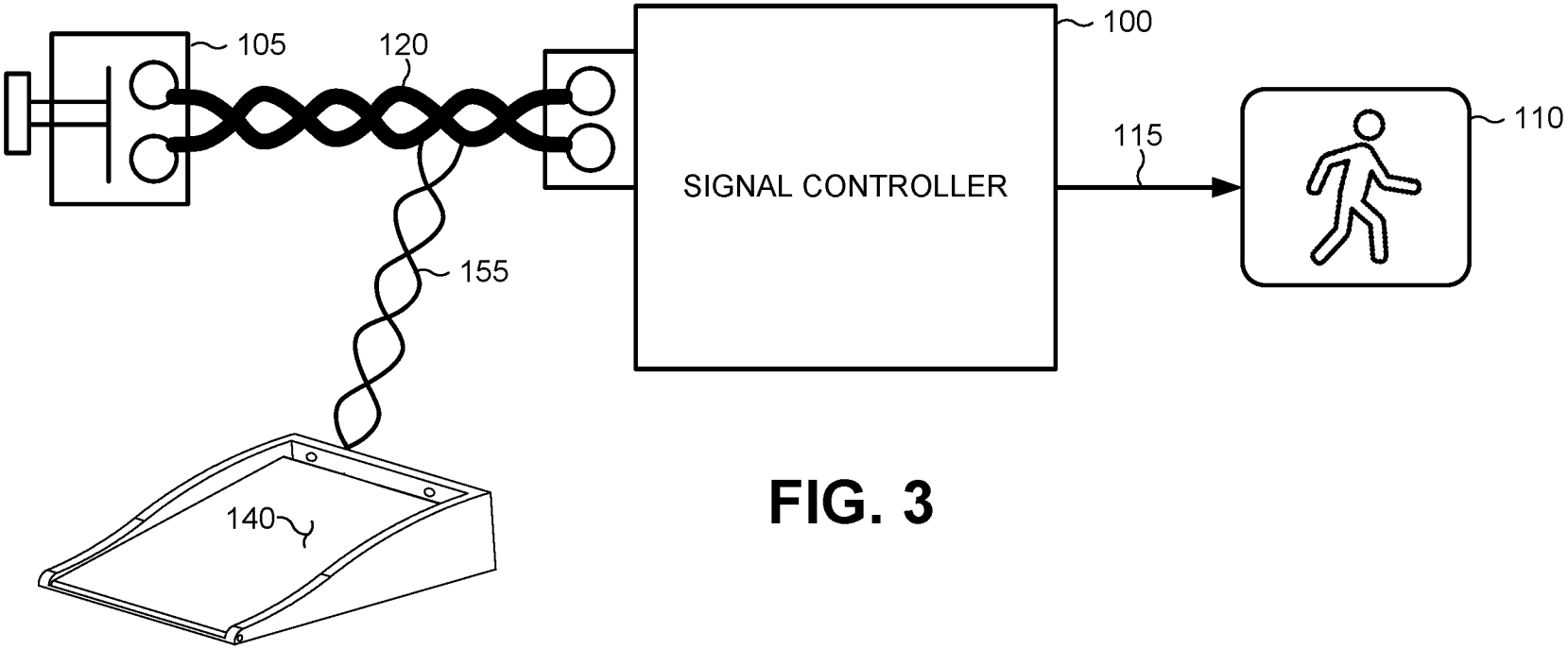
FIG. 3 is a block diagram that illustrates application of the present method in a street signal application.

FIG. 3 is a block diagram that illustrates application of the present method in a street signal application. This figure shows that a push to walk button 105 is electrically coupled to a signal controller 100. It should be appreciated that, in many instances and illustrative use cases, the electrical coupling of the push to walk button 105 is accomplished by means of a two conductor cable 120. When a user pushes the push to walk button 105, an electrical contact is affected. It should likewise be appreciated that, according to various illustrative use cases, the electrical contact is either made or broken when a user pushes the push to walk button 105. For example, when the push to walk button 105 comprises what is known as a "normally open" switch an electrical connection is made between the two wires included in the two conductor cable 120. Conversely, when the push to walk button 105 comprises what is known as a normally closed switch, the switch 105 would break a connection between the two wires included in the two conductor cable 120.

Figure 4:
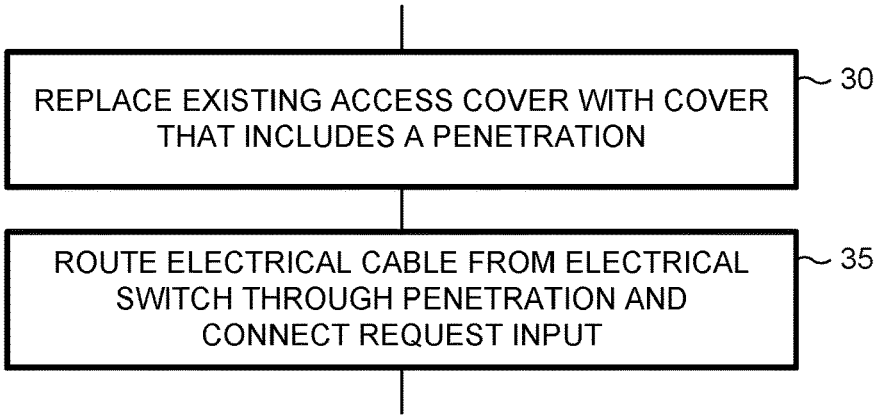
FIG. 4 is a flow diagram that depicts one alternative example method for electrically connecting the electrical switch to a push to walk request input.

FIG. 4 is a flow diagram that depicts one alternative example method for electrically connecting the electrical switch to a push to walk request input. This alternative example method includes a first step for replacing an existing access cover with a cover that includes a penetration (step 30). An additional step is included for routing an electrical cable (e.g. the two conductor cable 120 shown in FIG. 3) through the penetration and connecting the electrical cable to the request input (step 35).

Figure 5:
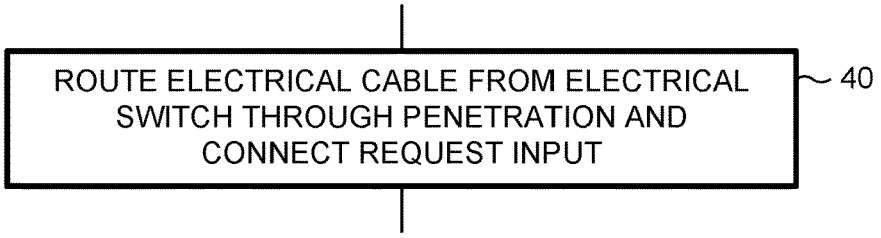
FIG. 5 is a flow diagram that depicts yet another alternative example method for electrically connecting the electrical switch to a push to walk input request.

FIG. 5 is a flow diagram that depicts yet another alternative example method for electrically connecting the electrical switch to a push to walk input request. This alternative example method includes a step for routing an electrical cable (e.g. the two conductor cable 120 shown in FIG. 3) through an existing penetration and connecting the electrical cable to the request input (step 40).

Figure 6:
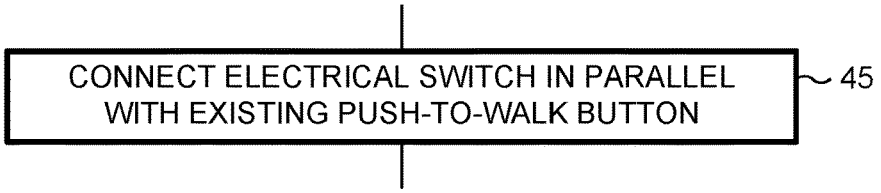
FIG. 6 is a flow diagram that depicts yet another alternative example method for electrically connecting the electrical switch to a push to walk input request.

FIG. 6 is a flow diagram that depicts yet another alternative example method for electrically connecting the electrical switch to a push to walk input request. According to this alternative example method, a step is included for connecting the electrical switch in parallel with an existing push to walk button (step 45). As heretofore described, when an existing push to walk button comprises a normally open switch, the electrical switch included in a pedal is connected in parallel with the push to walk button. This enables either of the original was to walk button or the pedal actuated switch to affect signaling of a push to walk request by connecting together two contacts included in a push to walk input.

Figure 7:
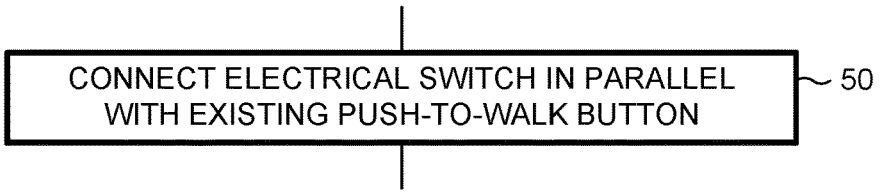
FIG. 7 is a flow diagram that depicts yet another alternative example method for electrically connecting the electrical switch to a push to walk input request.

FIG. 7 is a flow diagram that depicts yet another alternative example method for electrically connecting the electrical switch to a push to walk input request. According to this alternative example method, a step is included for connecting the electrical switch in series with an existing push to walk button (step 50). As heretofore described, when an existing push to walk button comprises a normally closed switch, the electrical switch included in a pedal is connected in series with the push to walk button. This enables either of the original was to walk button or the pedal actuated switch to affect signaling of a push to walk request by disconnecting from each other two contacts included in a push to walk input.

Figure 8:
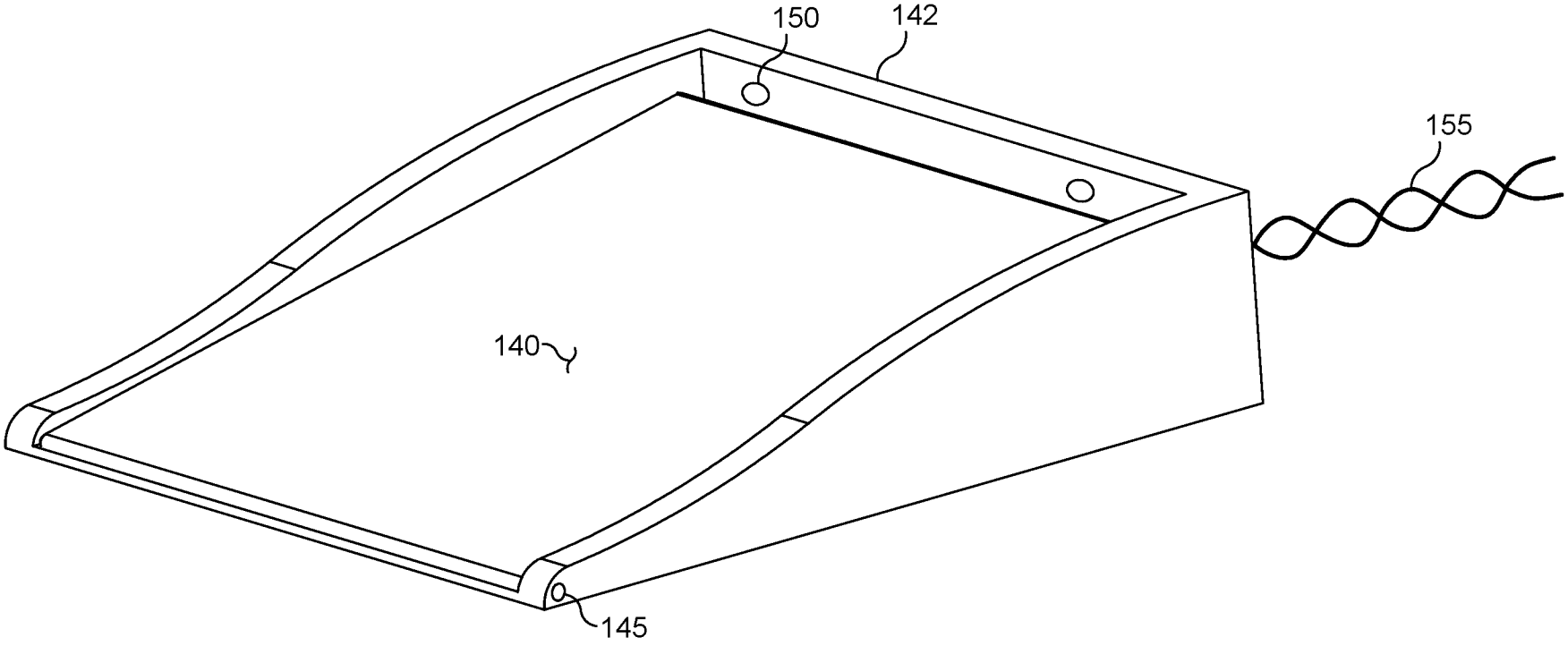
FIG. 8 is a pictorial diagram that illustrates one example embodiment of a pedal unit.

FIG. 8 is a pictorial diagram that illustrates one example embodiment of a pedal unit. In this example embodiment, the pedal unit includes a pedal 140 and a base assembly 142. It should be appreciated that, according to this example embodiment, the pedal 140 is rotationally coupled to the base assembly 142 by means of a hinge pin 145. It should be appreciated that, according to this example embodiment, the pedal 140 is disposed of a slope to enable a wheel to move on to the pedal in order to apply the downward force thereto. It should also be appreciated that, according to this example embodiment, the same pedal 140 is capable of accepting a downward force from a foot or some other object, for example a walking cane. Although not pictured in this figure, an electrical switch is also included in the base assembly 142. The electrical switch is electrically connected to a cable 155. In one alternative example embodiment the cable 155 comprises a two conductor cable.

Figure 9:
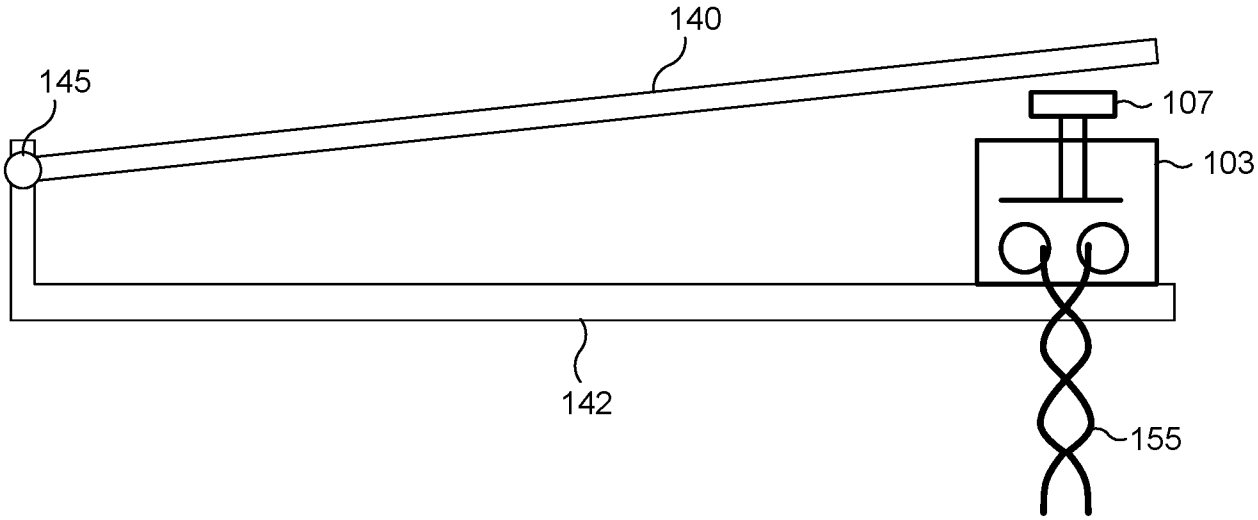
FIG. 9 is a cross-sectional view of a pedal unit.

FIG. 9 is a cross-sectional view of a pedal unit. As depicted in this figure, the pedal 140 is rotationally coupled to the base unit 142. Also included in the base unit 142 is the electrical switch 103. The electrical switch 105 includes a plunger 107 that affects electrical connection of the switch 103 when the plunger is pressed. It should be appreciated that, according to this alternative example embodiment, the pedal applies a force to the plunger 107 in order to actuate the electrical switch 103. In this alternative example embodiment, the electrical switch 103 includes two terminals which are electrically connected to a two conductor cable 155.

Figure 10:
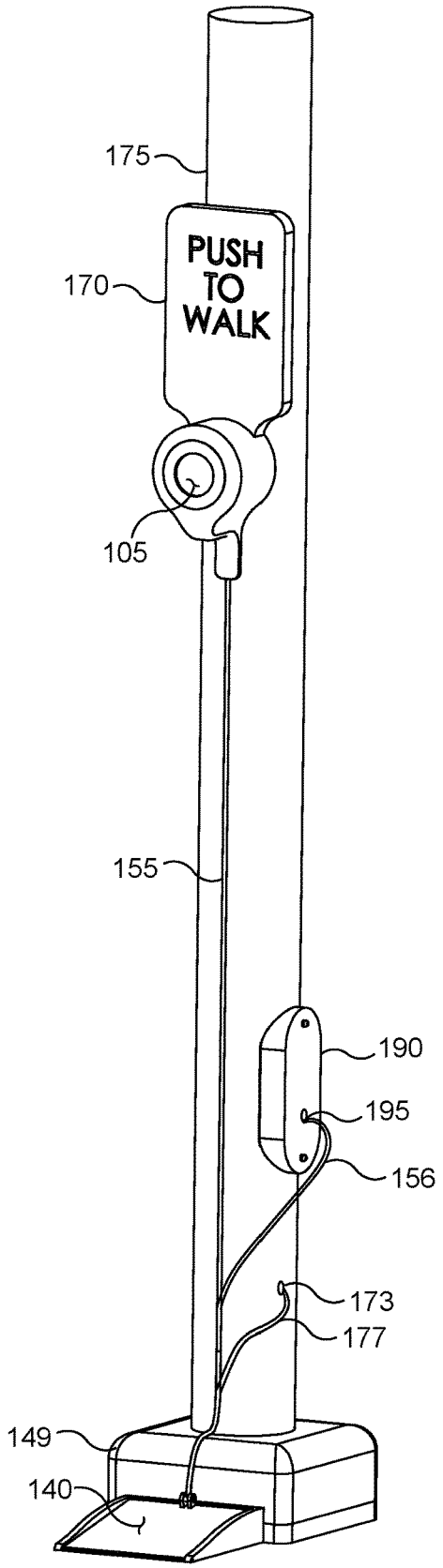
FIG. 10 is a pictorial illustration that depicts one example embodiment of a poll-supported push to walk button.

FIG. 10 is a pictorial illustration that depicts one example embodiment of a poll-supported push to walk button. According to one alternative example embodiment, poll-supported push to walk button comprises a poll 175, and a push to walk button assembly 170 which itself includes a push to walk button 105. It should be appreciated that, according to one alternative example embodiment, the push to walk button 105 is mounted on the pole at the height not more than 50 inches and not less than 34 inches from a surface upon which on included base 149 is disposed. This example embodiment of a poll-supported push to walk button further includes the pedal unit. In this alternative example embodiment, the pedal unit is disposed at the base 149 and rests upon a surface upon which the base is installed.

FIG. 10 also depicts application of one or more of the methods herein described. For example, according to one illustrative use case, the electrical switch 103 included in the base assembly 142 is connected to the request input by way of a pre-existing penetration 173. This is shown by alternative cable 177. According to yet another illustrative use case, the electrical switch 103 included in the base assemble 142 is routed through the penetration 195 included in a replacement cover plate 190 (alternative cable 156) used to cover an access panel included on the pole 175. Also, one illustrative use case provides that the cable 155 is connected directly to the push to walk button 105 itself.

While the present method and apparatus has been described in terms of several alternative and exemplary embodiments, it is contemplated that alternatives, modifications, permutations, and equivalents thereof will become apparent to those skilled in the art upon a reading of the specification and study of the drawings. It is therefore intended that the true spirit and scope of the claims appended hereto include all such alternatives, modifications, permutations, and equivalents.

What is claimed is:

1. A method for actuating a push-to-walk button:

receiving a force upon a levered-pedal disposed proximate to a base of a pole that is supporting the push-to-walk button;

mechanically conveying the received force to an electrical switch; and electrically connecting the electrical switch to a push-to-walk request input.

2. The method of claim 1 wherein receiving a force upon a pedal comprises at least one or more of receiving a force from a foot and/or receiving a force from a wheel.

3. The method of claim 1 wherein electrically connecting the electrical switch to a push-to-walk request input comprises replacing an electrical access cover plate included on the pole with a cover plate that includes an electrical penetration and routing through the penetration an electrical connection from the electrical switch to the push-to-walk request input.

4. The method of claim 1 wherein electrically connecting the electrical switch to a push-to-walk request input comprises drawing an electrical connection through a pre-existing penetration included in the pole.

5. The method of claim 1 wherein electrically connecting the electrical switch to a push-to-walk request input comprises connecting the electrical switch in parallel with an existing push-to-walk switch included on the pole.

6. The method of claim 1 wherein electrically connecting the electrical switch to a push-to-walk request input comprises connecting the electrical switch in series with an existing push-to-walk switch included on the pole.

7. A pole-supported push-to-walk button:

pole that includes a base for mounting on a surface;

levered-pedal for receiving a force from at least one or more of a foot and/or a wheel and wherein the levered-pedal is coupled to the pole proximate to the base said pole;

electrical switch mechanically coupled to the levered-pedal and disposed so as to be actuated when a force is applied to the levered-pedal;

push-to-walk button mounted on the pole at a height above the surface being not more than 50 inches and not less than 34 inches; and an electrical connection that connects the electrical switch to the push-to-walk button to enable at least one or more of the electrical switch and/or the push-to-walk to signal a request for crossing a street.

* * * * *